United States Patent [19]

Austin

[11] 4,266,716

[45] May 12, 1981

[54] CARTON WITH PYRAMID-SHAPED BOTTOM AND BLANK FOR FORMING SAME

[75] Inventor: John J. Austin, LeGrange, Ill.

[73] Assignee: Champion International Corporation, Stamford, Conn.

[21] Appl. No.: 115,021

[22] Filed: Jan. 24, 1980

[51] Int. Cl.[3] ..... B65D 5/10; B65D 5/36

[52] U.S. Cl. ..... 229/39 R; 229/41 R

[58] Field of Search ..... 229/41 C, 41 B, 41 R, 229/39 R, 1.5 B; 206/45.19

[56] References Cited

U.S. PATENT DOCUMENTS

| | | | |
|---|---|---|---|
| 1,002,346 | 9/1911 | Weeks | 229/1.5 B |
| 2,017,724 | 10/1935 | Neumann | 229/39 R X |
| 3,000,496 | 9/1961 | Larson | 229/39 R X |
| 3,684,157 | 8/1972 | Mendez | 229/41 R X |
| 3,824,623 | 8/1974 | Arneson | 229/39 R |
| 3,977,594 | 8/1976 | Swan | 229/41 C X |
| 4,065,047 | 12/1977 | Swan | 229/41 C |
| 4,185,764 | 1/1980 | Cote | 229/1.5 B X |

FOREIGN PATENT DOCUMENTS

| | | | |
|---|---|---|---|
| 505526 | 5/1939 | United Kingdom | 229/41 C |

*Primary Examiner*—Davis T. Moorhead

*Attorney, Agent, or Firm*—Evelyn M. Sommer

[57] ABSTRACT

A carton with a pyramid-shaped bottom and a blank for forming same has a collapsible pyramid-forming bottom structure which is hingedly coupled to the bottom edges of the side wall panels of the carton. The bottom structure comprises four triangular bottom panels, each of which is hingedly coupled to the bottom edge of one of the side wall panels and pairs of which are hingedly coupled together. One panel of each of the pairs of bottom panels has a locking tab with an abutment edge for abutting the abutment edge of the other locking tab to retain the carton in an assembled configuration against the bias of the carton towards its collapsed configuration. This permits the carton to be shipped and stored in essentially flat, collapsed configuration and then easily rearranged to its assembled configuration by the application of inwardly directed forces against side edges of the flat, collapsed configuration of the carton.

10 Claims, 10 Drawing Figures

CARTON WITH PYRAMID-SHAPED BOTTOM AND BLANK FOR FORMING SAME

BACKGROUND OF THE INVENTION

The present invention relates to a carton with a pyramid-shaped bottom and a blank for forming the carton. More particularly, the invention relates a collapsible pyramid-forming bottom structure which permits shipment of the partially assembled carton in a flat configuration, while allowing complete assembly and set up by a simple operation without the use of glue.

In constructing cartons or containers for certain articles, a pyramid-shaped bottom is often necessary. The bottom may serve to support the article for display purposes. The pyramid-shaped bottom may also be necessary to support and retain the article in a desired shape.

Since the carton manufacturer may be located far from the article manufacturer, the carton must be capable of being shipped in a flat, collapsed configuration to use shipping space efficiently. Otherwise, the carton would waste considerable space and prevent economical shipment.

Once at the article manufacturer, the partially assembled carton must be arranged for full assembly easily without the use of skilled personnel or complex machinery. Thus, the action necessary to convert the carton from its partially assembled, collapsed configuration to its fully assembled state must be extremely quick and simple.

SUMMARY OF THE INVENTION

Accordingly, it is an object of the present invention to provide a carton and a blank for forming a carton with a pyramid-shaped bottom structure which is collapsible so that the carton may be shipped in a flat, partially assembled, collapsed configuration.

Another object of the present invention is to provide a carton and a blank for forming a carton with a pyramid-shaped bottom that may be quickly and simply converted from a partially assembled, collapsed configuration to a fully assembled configuration without skilled personnel and without complex folding and gluing machinery.

An additional object of the present invention is to provide a carton and a unitary blank for forming a carton of rugged construction which is simple and inexpensive to manufacture, assemble and use.

The foregoing objects are obtained by providing a carton comprising first, second, third and fourth side wall panels hingedly coupled to adjacent side edges thereof along fold lines, the side wall panels having top and bottom edges, and a collapsible, pyramid-forming bottom structure hingedly coupled to the bottom edges along fold lines, the structure comprising first, second, third and fourth bottom panels hingedly attached along fold lines to the first, second, third and fourth side wall panels, respectively, each of the bottom panels being generally triangular and having bases attached to one of the side wall panels, and two side edges, means for hingedly coupling the first and second bottom panels and the third and fourth bottom panels, respectively, along respective adjacent side edges thereof, and first and second locking tabs extending from the second and fourth bottom panels, respectively, said tabs having abutment edges for abutting each other to retain the carton in an assembled configuration against a bias of the carton towards a collapsed configuration.

The foregoing objects are also obtained by a carton comprising first, second, third and fourth side wall panels hingedly coupled to adjacent side edges thereof along fold lines, the side wall panels having top and bottom edges, and a collapsible pyramid-shaped bottom structure hingedly coupled to the bottom edges along fold lines, the structure comprising first, second, third and fourth bottom panels hingedly attached along fold lines to the first, second, third and fourth side wall panels, respectively, each of the bottom panels being generally triangular and having bases attached to one of the side wall panels, an apex remote from one of the side wall panels and two side edges, first and second attachment means for hingedly coupling the first and second bottom panels and the third and fourth bottom panels, respectively, along respective adjacent side edges thereof, and first and second locking tabs extending from the second and fourth bottom panels, respectively, the tabs having abutment edges which abut each other to retain the carton in an assembled configuration against a bias of the carton toward a collapsed configuration.

The foregoing objects are additionally attained by a planar, unitary blank formed of paperboard and adapted to be folded into a carton with a pyramid-shaped bottom, comprising first, second, third and fourth side wall panels serially arranged and hingedly attached along fold lines at side edges thereof, each of the side wall panels having a top edge and a bottom edge, first, second, third and fourth bottom panels hingedly attached along fold lines to the first, second, third and fourth side wall panels, respectively, at the bottom edges thereof, each of the bottom panels being generally triangular and having a base attached to one of the side wall panels, an apex remote from one of the side wall panels and two side edges, first and second attachment flaps attached to two of said bottom panels at side edges thereof along fold lines, a wall panel attachment flap hingedly coupled to one of said first and fourth side wall panels at a free edge thereof along a fold line, and first and second locking tabs extending from alternate ones of the bottom panels adjacent the apexes thereof, for latching the alternative ones of the bottom panels together to maintain the carton formed from the blank in an assembled configuration.

By forming the carton and blank of the present invention in this manner, a carton may be provided which may be partially formed and shipped in a flat, collapsed configuration and then easily and simply rearranged to a fully assembled configuration in which the carton has a pyramid-shaped bottom. The rearrangement is accomplished by a simple manipulation without gluing, complex machinery or skilled personnel. Thus, the present invention permits cartons formed with a pyramid-shaped bottom to be easily and econimically manufactured, shipped and stored.

Other objects, advantages and salient features of the present invention will become apparent from the following detailed description, which taken in conjunction with the annexed drawings, discloses a preferred embodiment of the present invention.

As used in this application, the terms, "first", "second", "third", "fourth", "top" and "bottom", are intended to facilitate the description of the carton and the blank for forming the carton. Thus, such terms are merely illustrative of the carton and blank and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
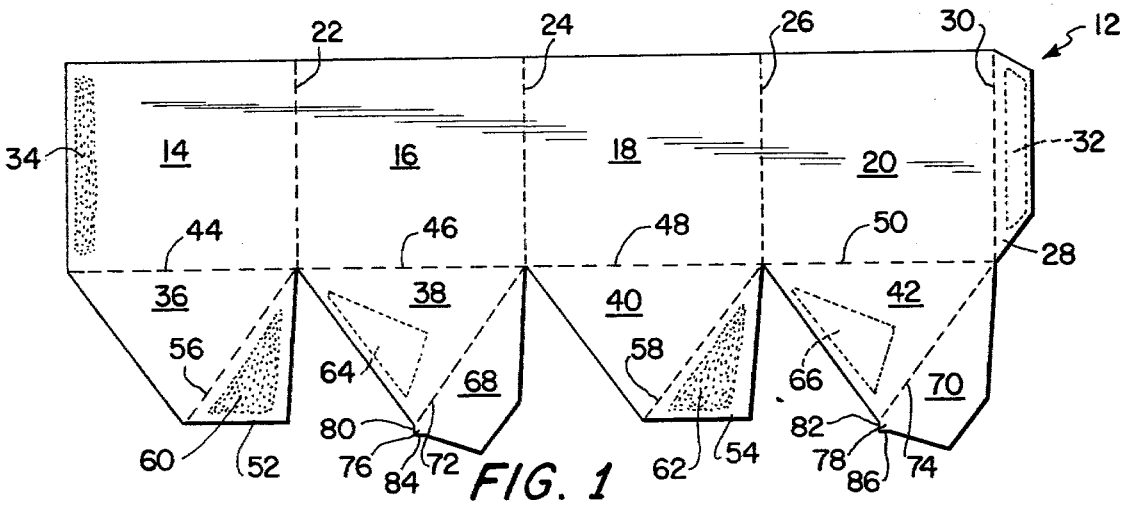
FIG. 1 is a plan view illustrating the interior surface of a blank for forming a carton in accordance with the present invention.

Referring to FIG. 1, the blank 12 may be formed of a unitary piece of paperboard of suitable weight and thickness. The weight and thickness of the paper depends on the size and weight of the article contained within the carton. FIG. 1 illustrates the surface which will form the interior surface of the carton.

The main portion of the carton comprises four side wall panels 14, 16, 18, 20. Each of these illustrated side wall panels are generally rectangular in shape; however, it should be noted that such side wall panels may be of any suitable configuration. The side wall panels 14, 16, 18, 20 are arranged in a series. The first side wall panel 14 is hingedly coupled to the second side wall panel 16 along the fold line 22. The second side wall panel 16 and the third side wall panel 18 are hingedly coupled along the fold line 24. The third side wall panel 18 and the fourth side wall panel 20 are hingedly coupled along the fold line 26.

A glue flap 28 is hingedly coupled to the free edge of the fourth side wall panel 20, which free edge is remote from the third side wall panel 18. The glue flap 28 is generally trapezoidal in shape with its longer base coincident with the fold line 30 hingedly attaching it to the side wall panel 20. The underside or outside surface of the glue flap 28 has a glue area 32 of generally elongated rectangular configuration. A mating glue area 34 is provided adjacent the free side edge of the first side wall panel 14 on the inside surface thereof. The glue area 34 is of generally elongated, rectangular configuration, and is generally of the same size as the glue area 32.

Four bottom panels 36, 38, 40, 42 which are hingedly coupled, respectively, along the bottom edges of the side wall panels 14, 16, 18, 20. Each of these bottom panels is in the form of an isosceles triangle, with its base extending from one of the side wall panels, its apex remote from one of the side wall panels and its two side edges extending between the base and apex. Fold lines 44, 46, 48, 50 hingedly couple the bottom panels 36, 38, 40, 42 to the side wall panels 14, 16, 18, 20, respectively. The fold lines 44, 46, 48, 50 are colinear and form the bottom edge of the side wall panels 14, 16, 18, 20.

Glue flaps 52, 54 are hingedly coupled to side edges of bottom panels 36, 40, respectively, along respective fold lines 56, 58. The glue flaps 52, 54 are generally in the form of right triangles with the hypotenuses thereof extending along the fold lines 56, 58, respectively. Located within the glue flaps 52, 54 are glue areas 60, 62, respectively, which are also generally in the form of right triangles. The second and fourth bottom panels 38, 42 have right triangular shaped glue areas 64, 66, respectively, on the outside surface of the blank which are shaped and oriented to mate with the glue areas 60, 62, respectively, when the blank is folded.

Locking tabs 68, 70 are attached to the side edges of the second and fourth bottom panels 38, 42 along the side edges thereof remote from the first bottom panel 36 and are hingedly coupled to the panels 38, 42 along fold lines 72, 74, respectively. Each of the locking tabs 68, 70 are generally trapezoidal in shape and have triangular abutment portions 76, 78 extending outwardly from the corner thereof located adjacent the apex of the triangular bottom panels 38, 42 (i.e., the corner of each triangular bottom panel 38, 42 remote from the fold lines 46, 50, respectively). The abutment portions 76, 78 are defined by abutment edges 80, 82 and cam edges 84, 86 formed at approximately right angles. The main or trapezoidal portion of the locking tabs 68, 70 are configured to permit the edges thereof to lie along or within the periphery of one of the bottom panels 36, 38, 40, 42 in the assembled configuration of the carton.

Figure 2:
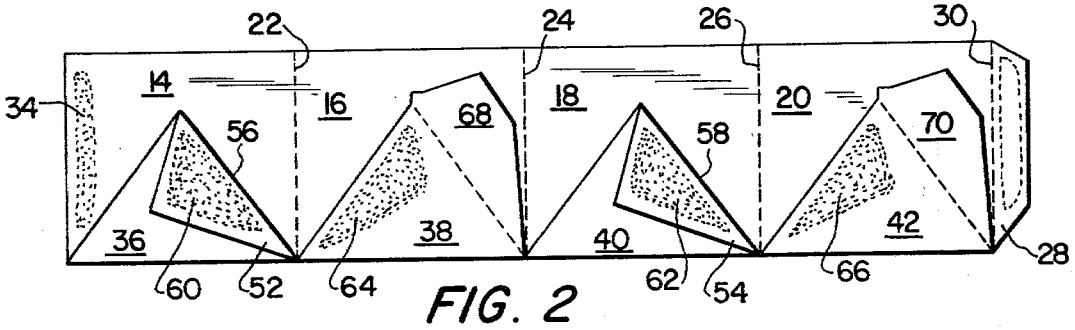
FIGS. 2 and 3 are plan views illustrating the blank of FIG. 1 in various stages of folding and gluing.

The carton 88 (illustrated in FIG. 5) is formed from the blank 12 of FIG. 1 by folding the bottom panels 36, 38, 40, 42 about the fold lines 44, 46, 48, 50, respectively, and by folding the glue flaps 52, 54 about the fold lines 56, 58, respectively. In this position, the bottom panels 36, 38, 40, 42 overlie the side wall panels 14, 16, 18, 20, respectively, and the glue flaps 52, 54 overlie the bottom panels 36, 40, respectively, as illustrated in FIG. 2. The locking tabs 68, 70 are not folded about the fold lines 72, 74, respectively, but are left coplanar with the bottom panels 38, 42, respectively. Similarly, the glue flap 28 is not folded about the fold line 30, but is left coplanar with the fourth side wall panel 20.

Figure 3:
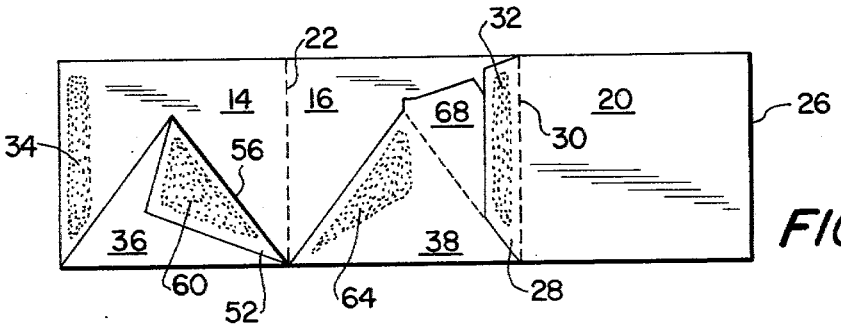

The side wall panels 18, 20 are folded about the fold line 26 to the position illustrated in FIG. 3 in which the side wall panels 18, 20 overlap, the bottom panels 40, 42 overlap and the glue areas 62, 66 mate. The adhesive applied on area 62 and/or area 66 affixes the glue flap 54 to the bottom panel 42 to hingedly couple the third and fourth bottom panels 40, 42 at the adjacent side edges thereof along fold line 58.

The first and second side wall panels, 14, 16 are folded about fold line 22 to a position in which the side wall panels 14, 16 overlap, the bottom panels 36, 38 overlap, the glue areas 60, 64 mate, and the glue areas 32, 34 mate. The adhesive applied to the area 60 and/or area 64 affixes the glue flap 52 to the outer surface of the bottom panel 38 to hingedly couple the bottom panels 36, 38 at the adjacent edges thereof along fold line 56. Similarly, the adhesive applied to area 32 and/or area 34 hingedly couples the first and fourth side wall panels 14, 20 at adjacent side edges thereof along the fold line 30.

Figure 4:
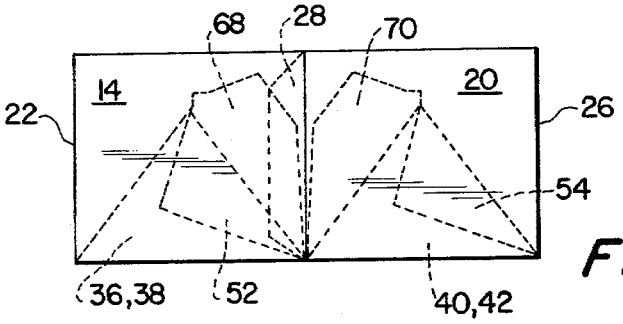
FIG. 4 is a plan view illustrating the blank of FIG. 1 after it has been folded and glued to its partially folded, collapsed configuration.

The blank 12 is now in the configuration illustrated in FIG. 4. This configuration represents a partially assembled, flat, collapsed configuration of the carton 88 in which it may be shipped stored and fully assembled simply, inexpensively and efficiently.

Figure 5:
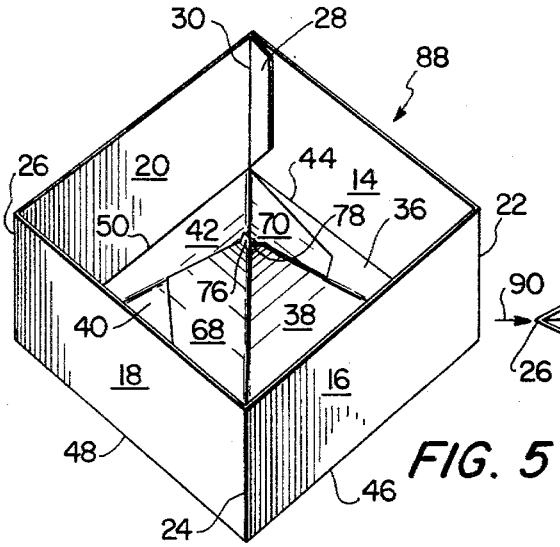
FIG. 5 is a perspective view illustrating the carton according to the present invention in its fully assembled configuration.
Figure 6:
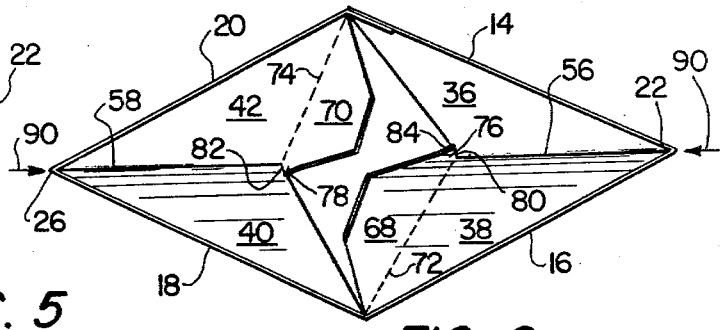
FIG. 6 is a top plan view of the carton of FIG. 5 in a partially collapsed configuration.

The fully assembled configuration of FIG. 5, is formed from the partially assembled, collapsed configuration of FIG. 4 by applying opposing forces represented by the arrows 90 against the side edges (i.e., fold lines 22, 26) of the FIG. 4 configuration. As illustrated in FIG. 6, these forces cause the carton 88 to open up with the bottom panels 36, 38, 40, 42 pivoting about fold lines 44, 46, 48, 50 away from their collapsed position against the side wall panels 14, 16, 18, 20, respectively. Additionally, the bottom panels 36, 42 pivot about fold line 56 and bottom panels 40, 42 pivot about fold line 58. In the configuration illustrated in FIG. 6, the locking tabs 68, 70 remain coplanar with the bottom panels 38, 42, respectively.

The forces indicated by arrows 90 are applied as the abutment portion 78 cams on the cam edge 84 until the abutment portion 78 has passed over the abutment portion 76. The abutment edges 80, 82 will then engage and the forces are relieved. The locking engagement of the locking tabs 68, 70 at the engagement of the abutment edges 80, 82 retain the carton 88 in its assembled configuration (illustrated in FIG. 7) against the bias or tendency of the carton 88 to resume the collapsed configuration of FIG. 4.

Figure 7:
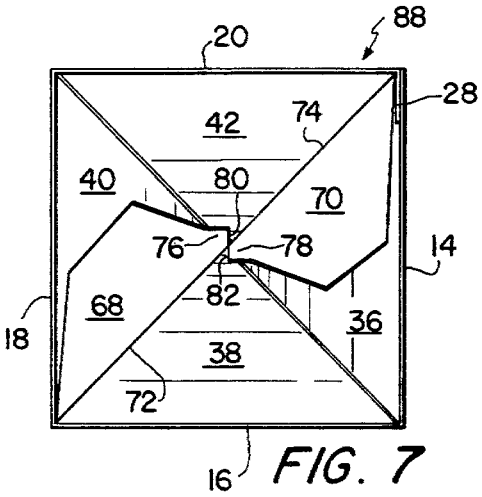
FIGS. 7 and 8 are top plan views of the carton of FIG. 5 in two folded configurations thereof.
Figure 8:
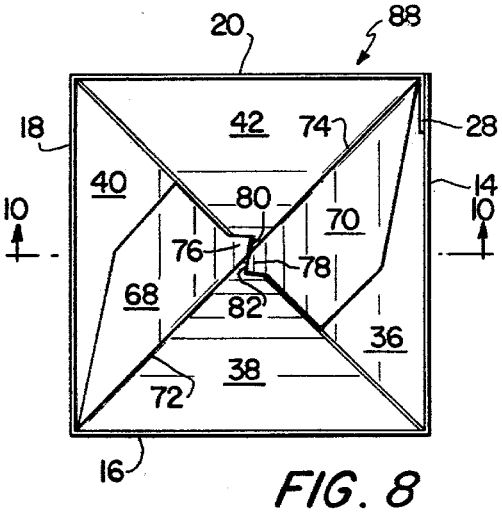
Figure 10:
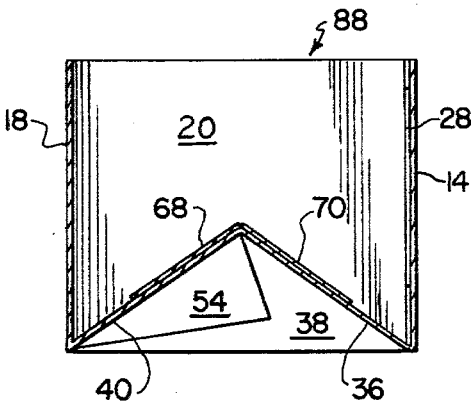
FIG. 10 is a side elevational view in section taken along lines 10—10 of FIG. 8 of the carton of FIG. 5.

In FIG. 7, the carton 88 is illustrated with the locking tabs 68, 70 still coplanar with the bottom panels 38, 42, respectively. The locking tabs 68, 70 may be pivoted about the fold lines 72, 74, respectively, to lie against the bottom panels 40, 36, respectively, as illustrated in FIGS. 5, 8 and 10. The pivoting action of the locking tabs 68, 70 may be accomplished automatically by placing the article within the container and upon the bottom structure formed by the bottom panels 36, 38, 40, 42, the glue flaps 52, 54, and the locking tabs 68, 70.

Figure 9:
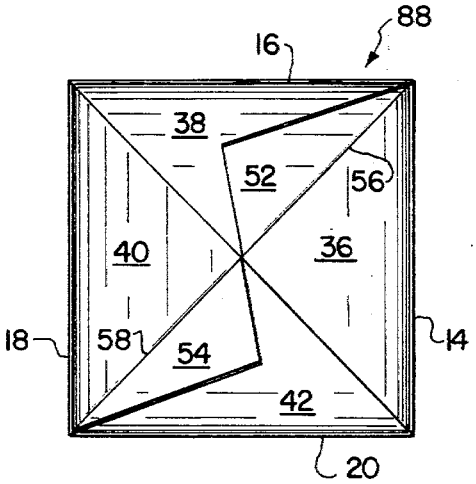
FIG. 9 is a bottom plan view of the carton of FIG. 5.

FIG. 9 illustrates the bottom of the fully assembled carton 88.

If desired, the carton 88 may be again arranged in the collapsed configuration of FIG. 4 by separating the abutment edges 80, 82 and applying inwardly directed forces against the edges of the carton 88 formed by the fold lines 30, 24.

By forming and folding the blank 12 and the carton 88 in this manner, the carton 88 may be shipped and stored in a substantially flat, collapsed configuration. The flat, collapsed carton may then be easily and simply formed into a fully assembled configuration in which the carton has a pyramid-shaped bottom by simply applying force to the edges of the carton formed by fold lines 22, 26. Thus, when the manufacturer of the article to be placed within the carton receives the carton in its collapsed configuration the carton may be simply assembled it without gluing, complex machinery or skilled personnel.

Additionally, once the article is placed within the carton 88 upon its pyramid-shaped bottom, the pyramid-shaped bottom will prevent the article from losing its shape, will protect the article from damage during shipping and will display the article if desired. Any suitable cover may be used to cover the container during shipment and/or display.

While a particular embodiment has been chosen to illustrate the invention, it will be understood by those skilled in this art that various changes and modifications can be made therein without departing from the scope of the invention as defined in the appended claims.

What is claimed is:

1. A carton comprising:

first, second, third and fourth side wall panels hingedly coupled to adjacent side edges thereof along fold lines, said side wall panels having top and bottom edges; and a collapsible, pyramid-forming bottom structure hingedly coupled to said bottom edges along fold lines, said structure comprising, first, second, third and fourth bottom panels hingedly attached along fold lines to said first, second, third and fourth side wall panels, respectively, each of said bottom panels being generally triangular and having bases attached to one of said side wall panels, and two side edges, means for hingedly coupling said first and second bottom panels and said third and fourth bottom panels, respectively, along respective adjacent side edges thereof, and first and second locking tabs extending from said second and fourth bottom panels, respectively, said tabs having abutment edges for abutting each other to retain the carton in an assembled configuration against a bias of the carton towards a collapsed configuration.

2. A carton comprising:

first, second, third and fourth side wall panels hingedly coupled to adjacent side edges thereof along fold lines, said side wall panels having top and bottom edges; and a collapsible, pyramid-shaped bottom structure hingedly coupled to said bottom edges along fold lines, said structure comprising, first, second, third and fourth bottom panels hingedly attached along fold lines to said first, second, third and fourth side wall panels, respectively, each of said bottom panels being generally triangular and having bases attached to one of said side wall panels, an apex remote from one of said side wall panels and two side edges, first and second attachment means for hingedly coupling said first and second bottom panels and said third and fourth bottom panels, respectively, along respective adjacent side edges thereof, and first and second locking tabs extending from said second and fourth bottom panels, respectively, said tabs having abutment edges which abut each other to retain the carton in an assembled configuration against a bias of the carton towards a collapsed configuration.

3. A carton according to claim 2, wherein said first and second locking tabs are hingedly coupled to said second and fourth bottom panels, respectively.

4. A carton according to claim 2, wherein said abutment edges extend from said apexes of said second and fourth bottom panels and generally perpendicular to said bases thereof.

5. A carton according to claim 2, wherein each of said first and second attachment means comprises a glue flap hingedly coupled along a fold line to one bottom panel at a side edge thereof and fixed to a surface of another bottom panel.

6. A planar, unitary blank formed of paperboard and adapted to be folded into a carton with a pyramid-shaped bottom, comprising:

first, second, third and fourth side wall panels serially arranged and hingedly attached along fold lines at side edges thereof, each of said side wall panels having a top edge and a bottom edge;

first, second, third and fourth bottom panels hingedly attached along fold lines to said first, second, third and fourth side wall panels, respectively, at the bottom edges thereof, each of said bottom panels being generally triangular and having a base edge, attached to one of said side wall panels, an apex remote from one of said side wall panels and two side edges;

first and second attachment flaps attached to two of said bottom panels at side edges thereof along fold lines;

a wall panel attachment flap hingedly coupled to one said first and fourth side wall panels at a free edge thereof along fold line; and first and second locking tabs, extending from alternate ones of said bottom panels adjacent said apexes thereof, for latching said alternate ones of said bottom panels together to maintain the carton formed from the blank in an assembled configuration.

7. A blank according to claim 6, wherein said first and second locking tabs extend from said second and fourth bottom panels, respectively.

8. A blank according to claim 6, wherein said first and second locking tabs have abutment edges which extend from said apexes of said alternate ones of said bottom panels and generally perpendicular to said bases thereof.

9. A blank according to claim 8, wherein said abutment surfaces face in the same direction.

10. A blank according to claim 6, wherein said first and second locking tabs are hingedly coupled to said alternate ones of said bottom panels at side edges thereof along fold lines.

* * * * *